US011383126B2

(12) United States Patent
Xia et al.

(10) Patent No.: US 11,383,126 B2
(45) Date of Patent: Jul. 12, 2022

(54) FLUID-DAMPED DIRECT-DRIVE BICYCLE RIDING PLATFORM AND USE METHOD THEREOF

(71) Applicant: JINHUA UNISKY TOOLS CO., LTD., Jinhua (CN)

(72) Inventors: Lu Xia, Jinhua (CN); Mingzheng Yan, Xiangtan (CN)

(73) Assignee: JINHUA UNISKY TOOLS CO., LTD., Jinhua (CN)

( * ) Notice: Subject to any disclaimer, the term of this patent is extended or adjusted under 35 U.S.C. 154(b) by 105 days.

(21) Appl. No.: 16/758,390

(22) PCT Filed: Mar. 31, 2020

(86) PCT No.: PCT/CN2020/082331

§ 371 (c)(1),
(2) Date: Apr. 22, 2020

(87) PCT Pub. No.: WO2020/200189

PCT Pub. Date: Oct. 8, 2020

(65) Prior Publication Data

US 2021/0228938 A1 Jul. 29, 2021

(30) Foreign Application Priority Data

Apr. 2, 2019 (CN) ..... 201910259417.2

(51) Int. Cl.
*A63B 22/06* (2006.01)
*A63B 21/008* (2006.01)
(Continued)

(52) U.S. Cl.
CPC ..... *A63B 22/0605* (2013.01); *A63B 21/008* (2013.01); *A63B 21/154* (2013.01);
(Continued)

(58) Field of Classification Search
CPC ..... A63B 22/0605; A63B 22/0664; A63B 22/0694; A63B 2022/0611;
(Continued)

(56) References Cited

U.S. PATENT DOCUMENTS 5,409,435 A * 4/1995 Daniels ..... F16D 57/002 482/901
8,052,581 B1 * 11/2011 Lohr ..... A63B 21/015 482/63

(Continued)

OTHER PUBLICATIONS

Wahoo, Kickr Core [online], Sep. 12, 2018, Retrieved from the Internet <URL: https://www.youtube.com/watch?v=Fi_w2vghs1k> (Year: 2018).*

*Primary Examiner* — Nyca T Nguyen
*Assistant Examiner* — Zachary T Moore
(74) *Attorney, Agent, or Firm* — Bayramoglu Law Offices LLC

(57) ABSTRACT

A fluid-damped direct-drive bicycle riding platform includes a rack for supporting, a main shaft, a transmission shaft and a fluid resistor, wherein the rack includes a front bottom foot tube, a rear bottom foot tube, a front support rod, a main beam and an angle adjuster; the front support rod is fixed on the front bottom foot tube, the main beam is fixed on the rear bottom foot tube, the angle adjuster is fixed on the main beam, the upper end of the front support rod is hinged to the angle adjuster through a spline, the main beam is provided with the main shaft and the transmission shaft, the main shaft is press-fitted on the main beam in an interference fit, the main shaft and transmission shaft are driven by a pulley and a belt to drive the liquid resistor fixed to the left end of the transmission shaft.

10 Claims, 3 Drawing Sheets

(51) Int. Cl.
*A63B 21/22* (2006.01)
*A63B 21/00* (2006.01)
*A63B 24/00* (2006.01)

(52) U.S. Cl.
CPC ..... *A63B 21/225* (2013.01); *A63B 24/0062* (2013.01); *A63B 2220/50* (2013.01); *A63B 2220/833* (2013.01)

(58) Field of Classification Search
CPC .... A63B 2022/0641; A63B 2022/0647; A63B 2022/0652; A63B 2022/0658; A63B 21/008; A63B 21/0084; A63B 21/154; A63B 21/225; A63B 24/0062; A63B 2220/50; A63B 2220/833; A63B 69/16
See application file for complete search history.

(56) References Cited

U.S. PATENT DOCUMENTS

| | | | | |
|---|---|---|---|---|
| 10,576,348 | B1 * | 3/2020 | Hawkins, III ..... | A63B 71/0622 |
| 2002/0137601 | A1 * | 9/2002 | Tobias ..... | A63B 21/00069 482/52 |
| 2003/0176260 | A1 * | 9/2003 | Chen ..... | A63B 22/0605 482/57 |
| 2007/0117680 | A1 * | 5/2007 | Neff ..... | A63B 24/0084 482/8 |
| 2011/0287902 | A1 * | 11/2011 | Bingham, Jr. ..... | A63B 69/16 482/61 |
| 2017/0105523 | A1 * | 4/2017 | McBride ..... | A63B 22/0605 |

* cited by examiner

FLUID-DAMPED DIRECT-DRIVE BICYCLE RIDING PLATFORM AND USE METHOD THEREOF

CROSS REFERENCE TO THE RELATED APPLICATIONS

This application is the national phase entry of International Application No. PCT/CN2020/082331, filed on Mar. 31, 2020, which is based upon and claims priority to Chinese Patent Application No. 201910259417.2, filed on Apr. 2, 2019, the entire contents of which are incorporated herein by reference.

TECHNICAL FIELD

The present invention relates to the technical field of sports training and fitness equipment, and in particular to a fluid-damped riding platform for bicycle training and fitness and a use method thereof.

BACKGROUND

The direct-drive bicycle riding platform using a fluid-damped technology has just started in foreign countries and is still blank in China. The damping technology of the existing direct-drive bicycle riding platform is mostly an electromagnetic damping device, which uses the working principle of changing the electromagnetic strength by changing the current of an electromagnetic coil, so as to control the damping size. Such type of direct-drive bicycle riding platforms have the following disadvantages: the riding platform needs to be connected to a mains supply, is only suitable for the occasions with a power source, needs additional energy consumption, adapts to restricted occasions, and does not achieve low carbon and environmental protection; a gear needs to be set to adjust the coil current so as to change the damping size; a main shaft is fixed in height, cannot be adjusted and is only applicable to specific types of bicycles, and the types of applicable bicycles are limited; the rack is mostly a welded overall structure and has a large packaging volume and high package and transportation costs, which causes resource waste; and due to the working principle of an electromagnetic field, the noise is relatively large caused by an electromagnetic noise plus a mechanical transmission noise per se.

SUMMARY

The technical problem to be solved by the present invention is to provide a fluid-damped direct-drive bicycle riding platform, with the advantages that a main shaft is adjustable in height, is suitable for any occasion, and is more low-carbon and environment-friendly; the damping size is adjusted in a fluid-damped stepless manner, and the riding is smoother; the rack can be disassembled for package, thereby saving package and transportation costs and resources are saved; and the fluid-damped device is fully closed, so that the noise diffusion is blocked and greater silence is realized.

In order to solve the above problem, the present invention adopts the following technical solution:

A fluid-damped direct-drive bicycle riding platform comprises a rack for supporting, a main shaft and a transmission shaft, wherein the rack comprises a front bottom foot tube, a rear bottom foot tube, a front support rod, a main beam and an angle adjuster, the front support rod is fixed on the front bottom foot tube by bolts, the main beam is fixed on the rear bottom foot tube by bolts, the angle adjuster is fixed on the main beam by bolts, the upper end of the front support rod is hinged to the angle adjuster through a spline, the main beam is provided with the main shaft and the transmission shaft, the main shaft is press-fitted on the main beam in an interference fit, the transmission shaft is fixed on the main beam through a bearing, the left end of the transmission shaft is connected to a fluid resistor, the right end of the transmission shaft is fixed with a small pulley, a large pulley sleeves the side of the main shaft located on the small pulley, and a belt playing a driving role sleeves the outer sides of the small pulley and the large pulley.

The further technical solution is that a shell of the fluid resistor is fixed on the main beam, and a transmission component in the fluid resistor is linked with the transmission shaft. The outer shell body of the fluid resistor is fixed to the main beam by bolts or other connection methods, but the transmission component playing a damping role inside is linked with the left end of the transmission shaft.

The further technical solution is that the large pulley sleeves the main shaft through a bearing, the large pulley is rotatably connected around the main shaft, and the small pulley is screwed on threads on the right side of the transmission shaft by the threads.

The further technical solution is that a belt tensioning pulley is also fixed on the main beam between the small pulley and the large pulley, and the outer side surface of the belt tensioning pulley abuts against a belt. The belt tensioning pulley is fixed on the main beam by bolts to adjust the tension of the belt.

The further technical solution is that a belt inner cover is fixed to the main beam, a belt outer cover is fixed to the outer side of the belt inner cover, and both the small pulley and the belt tensioning pulley are located inside the belt inner cover and the belt outer cover. The belt outer cover is connected to the belt inner cover by bolts. The belt inner cover and the belt outer cover cover the lower half section of the belt for safety protection.

The further technical solution is that a tower base is further connected to the large pulley, and a flywheel sleeves the tower base. A pawl of the tower base is sleeved in a pawl ring gear of the large pulley and the flywheel sleeves the bicycle tower base.

The further technical solution is that a power meter is further fixed to the inner side of the top end of the main beam, and a power module fixing base is fixed at the top end of the main beam. The power meter is clamped in the power module fixing base. The power module fixing base and the power meter are fixed to the main beam together by bolts.

The further technical solution is that a left sleeve shaft and a spacer bush are connected to the left end of the main shaft, and a right sleeve shaft is connected to the right side of the main shaft by threads. The left sleeve shaft for supporting a bicycle rear fork is sleeved into the spacer bush for adjusting the distance of the bicycle rear fork, and the left sleeve shaft and the spacer bush are then sleeved in a shaft hole in the left end of the main shaft together. The right sleeve shaft for supporting the bicycle rear fork is screwed on a threaded shaft at the right end of the main shaft.

The further technical solution is that the left and right tube ends of the front bottom foot tube and the rear bottom foot tube are sleeved into foot pads for supporting and slip prevention.

The further technical solution is that the power meter comprises a power module 701 and a sensing element 702, the power module 701 is mounted on the power module fixing base, the power module fixing base is provided with a power module fixing slot 27, and the power module 701 is inserted into the power module fixing slot 27 to be fixed; and the sensing element 702 is fixed at one side of the large pulley, the sensing element 702 transmits a signal to the power module 701, and the power module 701 and an intelligent device realize signal transmission by wireless connection. When the large pulley rotates around the main shaft, the sensing element 702 fixed thereon is driven to rotate, every time the sensing element 702 passes by the power module 701, the power module 701 is sensed once, the number of rotation is counted, and the corresponding speed, mileage, and power are calculated by an electronic chip inside the power module 701. The power module 701 realizes signal transmission with the intelligent device through wireless connection, and digital visualization can be realized on these terminal devices.

The further solution is that one side of the large pulley opposite to the main beam is provided with a sensing element fixing groove 28 for placing the sensing element, the sensing element is fixed in the groove by an adhesive, and the sensing element is located in the belt inner cover and the belt outer cover.

The present invention further discloses a convenient-to-use method for using a fluid-damped direct-drive bicycle riding platform, comprising: 1) firstly, adjusting the height of an included angle between the front support rod and the main beam by screwing on and off the spline: 2) then removing a bicycle rear wheel, erecting the bicycle rear fork on the left sleeve shaft and the right sleeve shaft on the riding platform, and locking by a bicycle quick tightening shaft; 3) hanging a bicycle chain on the flywheel on the riding platform and riding the bicycle, the bicycle chain driving the flywheel on the riding platform to rotate; 4) driving the large pulley to rotate through the tower base, driving the small pulley to rotate by the large pulley through transmission of the belt, and driving the transmission shaft to rotate by the small pulley: and 5) driving the fluid resistor to work by the transmission shaft, and generating a resistance by using the damping characteristics of a viscous fluid to consume the work done by a rider, so as to achieve training and fitness purposes.

The present invention has the beneficial effects: the object of the present invention is to provide a direct-drive bicycle riding platform of a new structure: a fluid-damped direct-drive bicycle riding platform in view of the current development status of domestic fluid-damped bicycle riding platforms and the shortcomings of the existing electromagnetic damped direct-drive bicycle riding platforms, and the damping technology adopts a fluid-damped device, and the blank that the domestic direct-drive bicycle riding platforms use the fluid-damped technology is filled; the height of the main shaft of the riding platform can be freely adjusted, and the rack is a large component assembly structure. The direct-drive bicycle riding platform according to the present invention does not need to be connected to any power source, is suitable for any occasion, does not consume additional energy, and is more low-carbon and environment-friendly. The damping size is adjusted in a fluid-damped stepless manner. The higher the rotating speed is, the greater the damping is, and the smoother the riding is; the main shaft is adjustable in height and is suitable for a wider range of bicycles; the rack can be disassembled for package, thereby saving package and transportation costs, and resources are saved; and the fluid-damped device is fully enclosed to block noise diffusion and realize greater silence.

BRIEF DESCRIPTION OF THE DRAWINGS

To more clearly describe the technical solutions in the embodiments of this application or in the prior art, the following will briefly introduce the drawings required for describing the embodiments or the prior art. It is apparent that the drawings in the following description are only some embodiments described in this application, and a person of ordinary skill in the art may obtain other drawings on the basis of these drawings without any creative effort.

In FIG. 1 to FIG. 3: 1—fluid resistor; 2—rack; 3—transmission shaft; 4—belt inner cover; 5—left sleeve shaft; 6—spacer bush; 7—power meter; 8—power module fixing base; 9—main shaft; 10—large pulley; 11—tower base; 12—flywheel; 13—right sleeve shaft; 14—belt outer cover; 15—belt tensioning device; 16—small pulley; 17—belt; 18—bolt, nut; 21—front bottom foot tube; 22—front support rod; 23—angle adjuster; 24—main beam; 25—rear bottom foot tube; 26—foot pad; 27—power module fixing slot; 28—sensing element fixing groove.

DETAILED DESCRIPTION OF THE EMBODIMENTS

In the following, preferred embodiments of the present invention are described in detail with reference to the accompanying drawings, to make advantages and features of the present invention more easily understood by a person skilled in the art, to further make a clearer definition on the protection scope of the present invention.

Figure 1:
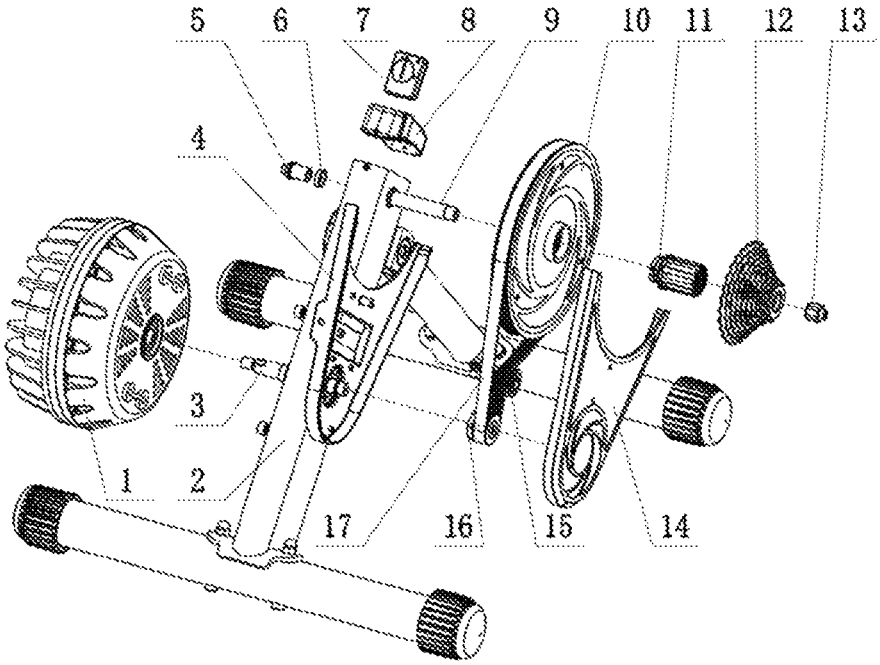
FIG. 1 is an exploded view of a fluid-damped direct-drive bicycle riding platform of the present invention.
Figure 2:
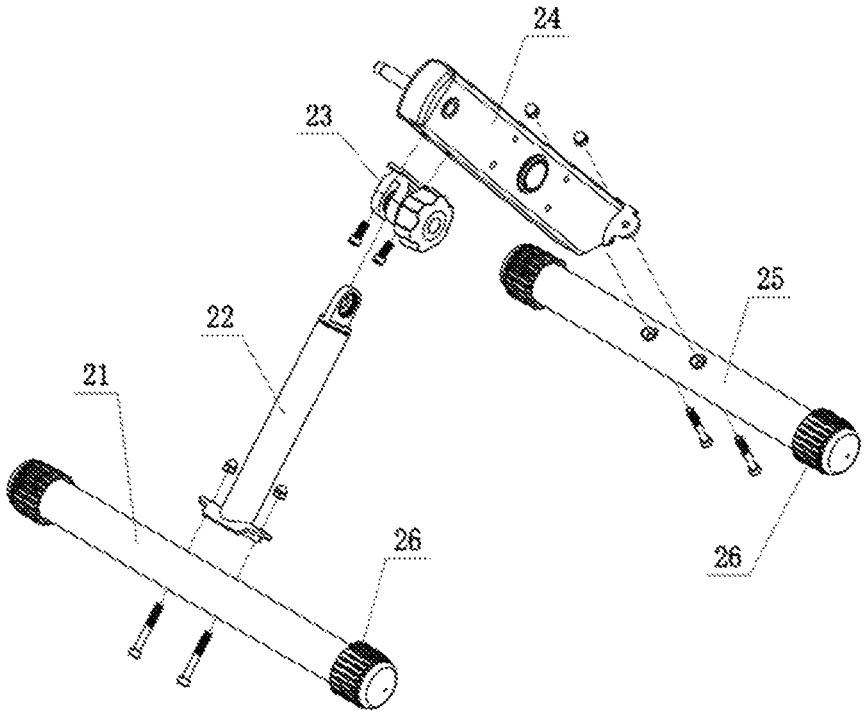
FIG. 2 is an exploded view of a rack in a fluid-damped direct-drive bicycle riding platform of the present invention.
Figure 3:
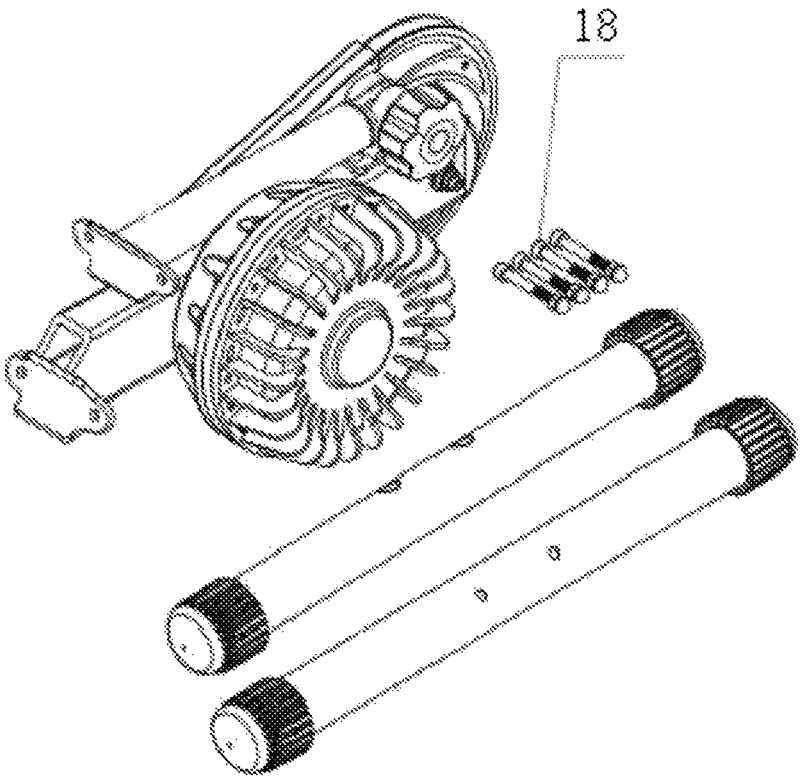
FIG. 3 is a schematic diagram of a fluid-damped direct-drive bicycle riding platform during package and transportation according to the present invention.
Figure 4:
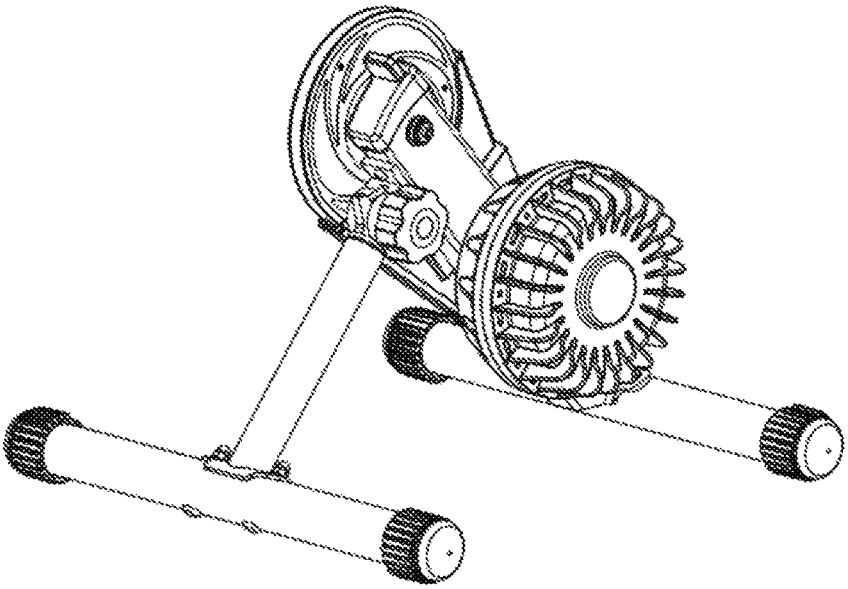
FIG. 4 is a general assembly diagram of a fluid-damped direct-drive bicycle riding platform of the present invention.
Figure 5:
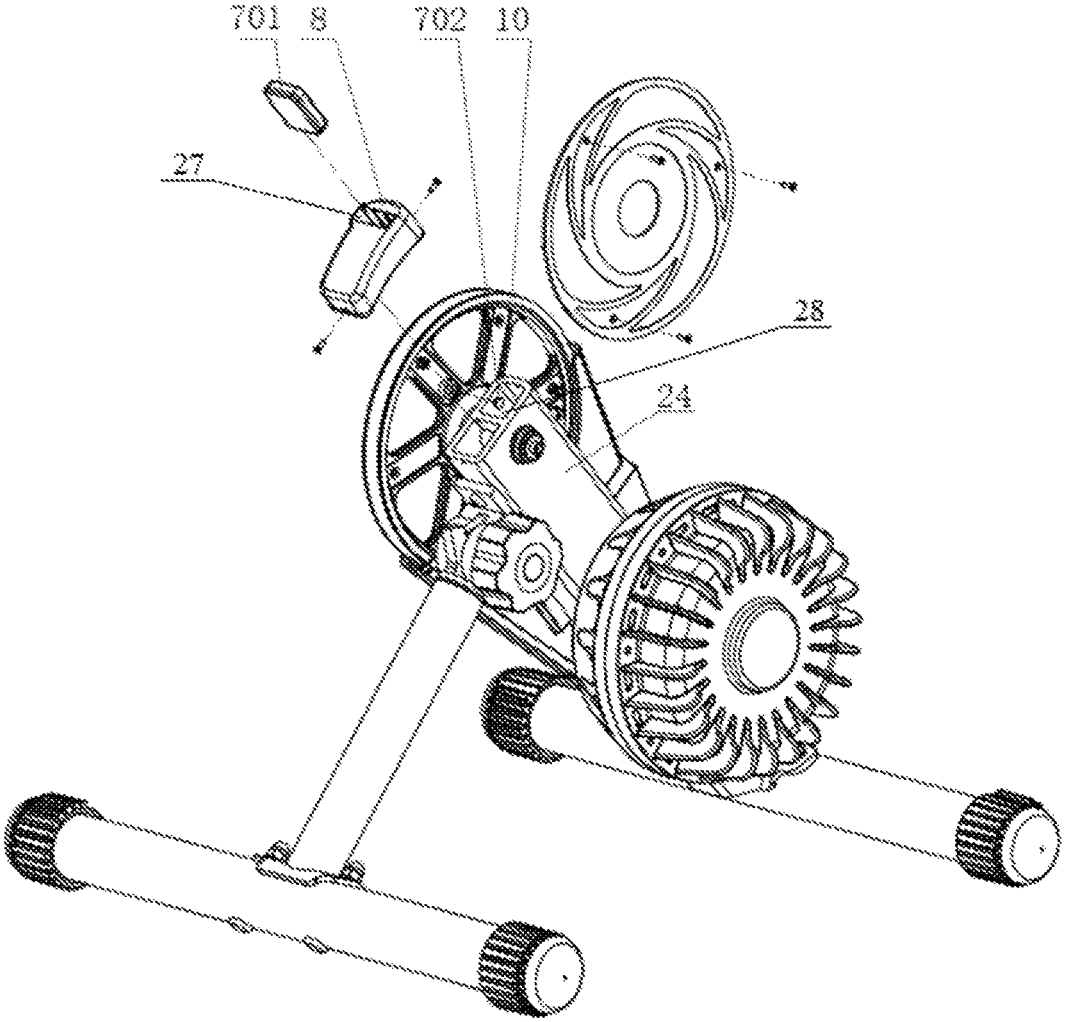
FIG. 5 is an exploded view of a power meter in a fluid-damped direct-drive bicycle riding platform of the present invention.

Referring to FIG. 1 to FIG. 3, a fluid-damped direct-drive bicycle riding platform comprises a rack 2 for supporting, a main shaft 9, and a transmission shaft 3. The rack 2 comprises a front bottom foot tube 21 and a rear foot bottom foot tube 25, a front support rod 22, a main beam 24 and an angle adjuster 23. The front support rod 22 is fixed to the front bottom foot tube 21 by bolts, the main beam 24 is fixed to the rear bottom foot tube 25 by bolts, and the angle adjuster 23 is fixed to the main beam 24 by bolts. The upper end of the front support rod 22 is hinged to the angle adjuster 23 by a spline. The main beam 24 is provided with the main shaft 9 and the transmission shaft 3, and the main shaft 9 is press-fitted on the main beam 24 in an interference fit. The transmission shaft 3 is fixed on the main beam 24 through a bearing, the left end of the transmission shaft 3 is connected to a fluid resistor 1, and the right end of the transmission shaft is fixed with a small pulley 16. A large pulley 10 sleeves the side of the main shaft 9 located on the small pulley 16, and a belt 17 playing a driving role sleeves the outer sides of the small pulley 16 and the large pulley 10.

A shell of the fluid resistor 1 is fixed on the main beam 14. A transmission component in the fluid resistor 1 is linked with one end of the transmission shaft 3. The outer shell of the fluid resistor 1 is fixed on the main beam 14 by bolts or other connection methods, but the transmission component which plays a damping role inside is linked with the left end of the transmission shaft 3. The large pulley 10 sleeves the main shaft 9 through a bearing, and the large pulley 10 is rotatably connected around the main shaft 9. The small pulley 16 is screwed on the threads on the right side of the transmission shaft 3 by threads. A belt tensioning pulley 15 is also fixed on the main beam 24 between the small pulley 16 and the large pulley 10. The outer side surface of the belt tensioning pulley 15 abuts against the belt 17. The belt tensioning pulley 15 is fixed on the main beam 24 by bolts. The tension of the belt is adjusted. A belt inner cover 4 is also fixed to the main beam 24. A belt outer cover 14 is fixed to the outer side of the belt inner cover 4. The small pulley 16 and the belt tensioning pulley 15 are both located in the belt inner cover 4 and the belt outer cover 14. The belt outer cover 14 is connected with the belt inner cover 4 by bolts. The belt inner cover 4 and the belt outer cover 14 cover the lower half section of the belt 17 for safety protection. The large pulley 10 is also connected to a tower base 11 and a flywheel 12 sleeves the tower base 11. A pawl of the tower base 11 is sleeved in a pawl ring gear of the large pulley 10 and the flywheel 12 sleeves the bicycle tower base 11. A power meter 7 is also fixed to the inner side of the top end of the main beam 24. A power module fixing base 8 is also fixed at the top end of the main beam 24. The power meter 7 is clamped in the power module fixing base 8. The power module fixing base 8 and the power meter 1 are fixed to the main beam 24 together by bolts. The left end of the main shaft 9 is also connected to a left sleeve shaft 5 and a spacer bush 6. The right side of the main shaft 9 is connected to a right sleeve shaft 13 by threads. The left sleeve shaft 5 for supporting a bicycle rear fork is sleeved into the spacer bush 6 for adjusting the distance of the bicycle rear fork, and the left sleeve shaft 5 and the spacer bush 6 are then sleeved in a shaft hole in the left end of the main shaft 9 together. The right sleeve shaft 13 for supporting the bicycle rear fork is screwed on a threaded shaft at the right end of the main shaft 9. The left and right tube ends of the front bottom foot tube 21 and the rear bottom foot tube 25 are sleeved into foot pads 26 for supporting and slip prevention.

The power meter comprises a power module 701 and a sensing element 702. The power module 701 is mounted on the power module fixing base 8, the power module fixing base 8 is provided with a power module fixing slot 27, and the power module 701 is inserted into the power module fixing slot 27 to be fixed. One side of the large pulley 10 opposite to the main beam 24 is provided with a sensing element fixing groove 28 for placing the sensing element 702, and the sensing element 702 is fixed in the sensing element fixing groove 28 by an adhesive. The sensing element 702 is located in the belt inner cover and the belt outer cover. The sensing element 702 transmits a signal to the power module 701, and the power module 701 and an intelligent device realize signal transmission by wireless connection. When the large pulley 10 rotates around the main shaft 9, the sensing element 702 fixed thereon is driven to rotate, every time the sensing element 702 passes by the power module 701, the power module 701 is sensed once, the number of rotation is counted, and the corresponding speed, mileage, and power are calculated by an electronic chip inside the power module. The power module 701 realizes signal transmission with the intelligent device (such as a mobile phone, a computer, a power meter and the like) through wireless connection, and digital visualization can be realized on these terminal devices. Moreover, the power module 701 may also be connected to mainstream cycling game platforms (such as Zwift, Viscene, Onelap, UHfitness, Strava) in China and other countries through the intelligent device (such as the mobile phone, the computer and the like) to perform cycling training and competition on real or simulated cycling routes, and the speed, mileage and power are visualized at the same time.

The method for using a fluid-damped direct-drive bicycle riding platform of the present invention comprises: 1) firstly, adjusting the height of an included angle between the front support rod 22 and the main beam 24 by screwing on and off the spline: 2) then removing a bicycle rear wheel, erecting the bicycle rear fork on the left sleeve shaft 5 and the right sleeve shaft 13 on the riding platform, and locking by a bicycle quick tightening shaft; 3) hanging a bicycle chain on the flywheel on the riding platform and riding the bicycle, the bicycle chain driving the flywheel 12 on the riding platform to rotate; 4) driving the large pulley 10 to rotate through the tower base, driving the small pulley 16 to rotate by the large pulley 10 through transmission of the belt 17, and driving the transmission shaft 3 to rotate by the small pulley 16; and 5) driving the fluid resistor 3 to work by the transmission shaft, and generating a resistance by using the damping characteristics of a viscous fluid to consume the work done by a rider, so as to achieve training and fitness purposes.

In the present embodiment, the angle adjuster 23 can freely adjust the included angle between the front support rod 22 and the main beam 24. After the included angle between the front support rod 22 and the main beam 24 is changed, the height of the main shaft 9 from the ground is changed in order to be suitable for a variety of types of bicycles (the bicycles have different models and the heights of the rear forks are different).

The power meter 7 calculates the values of power and a bicycle speed in real time, and is connected with a mobile phone or computer through wireless transmission, and the real-time values of the power and bicycle speed are displayed on the mobile phone or computer, to instruct riders in training and fitness.

When the product is packaged, the package is disassembled. The product can be disassembled into a state by assembling and folding the support rod 22, the main beam 24, the belt inner cover 4, the belt outer cover 14, and the fluid resistor 1, and then can be disassembled into a state that the front bottom foot tube 21 and the rear bottom foot tube 25 are provided with the foot pads 26, and the bolts and nuts 34 for mounting and connection also exist, thereby reducing the packaging volume and saving costs.

Compared with the existing direct-drive bicycle riding platform, the present invention has the advantages that the fluid-damped technology is applied for the first time on a direct-drive bicycle riding platform in China, and the product structures of the direct-drive bicycle riding platform are enriched. The direct-drive bicycle riding platform of the present invention does not need to be connected to any power source, is suitable for any occasion, does not consume additional energy, and is more low-carbon and environment-friendly. The damping size is adjusted in a fluid-damped stepless manner. The damping characteristic is smooth, and the riding feeling is smoother; the main shaft can be adjusted in height, and is applied to a wider range of bicycles; the rack can be disassembled for package, thereby saving package and transportation costs, and saving resources; and the fluid-damped device is sealed in a closed oil cavity to block noise diffusion and achieve greater silence.

The descriptions are only specific implementations of the present invention, but are not intended to limit the protection scope of the present invention. Any variation or replacement readily figured out without creative efforts shall fall within the protection scope of the present invention.

What is claimed is:

1. A fluid-damped direct-drive bicycle riding platform, comprising a rack for supporting, a main shaft and a transmission shaft; wherein the rack comprises a front bottom foot tube, a rear bottom foot tube, a front support rod, a main beam and an angle adjuster; the front support rod is fixed on the front bottom foot tube by a first plurality of bolts, the main beam is fixed on the rear bottom foot tube by a second plurality of bolts, the angle adjuster is fixed on the main beam by a third plurality of bolts, an upper end of the front support rod is hinged to the angle adjuster, the main beam is provided with the main shaft and the transmission shaft, the main shaft is press-fitted on the main beam in an interference fit, the transmission shaft is fixed on the main beam through a first bearing, a left end of the transmission shaft is connected to a fluid resistor, a right end of the transmission shaft is fixed with a first pulley, a second pulley sleeves a side of the main shaft located on the first pulley, and a belt configured for driving sleeves an outer side of the first pulley and an outer side of the second pulley;

wherein the fluid resistor is driven by the transmission shaft, resistance of the fluid resistor is generated by a viscous fluid, the fluid resistor is fully closed by a shell, and the fluid resistor contains a transmission component that plays a damping role inside the shell such that a higher rotating speed causes greater damping, wherein the shell of the fluid resistor is fixed on the main beam, and the transmission component in the fluid resistor is linked with the left end of the transmission shaft;

wherein a power module fixing base is fixed at the top end of the main beam and a power meter is mounted on the power module fixing base;

wherein the power meter comprises a power module and a sensing element, the power module is mounted on the power module fixing base, and the sensing element is fixed at a side of the second pulley opposite to the main beam;

wherein, when the second pulley rotates, the sensing element fixed on the second pulley is driven to rotate; and every time the sensing element passes by the power module, the sensing element transmits a signal to the power module, and the power module transmits the signal to an intelligent device.

2. The fluid-damped direct-drive bicycle riding platform according to claim 1, wherein the second pulley sleeves the main shaft through a second bearing, the second pulley is rotatably connected around the main shaft, and the first pulley is screwed on the right end of the transmission shaft by threads.

3. The fluid-damped direct-drive bicycle riding platform according to claim 1, wherein a belt tensioning pulley is further fixed on the main beam between the first pulley and the second pulley, and an outer side surface of the belt tensioning pulley abuts against the belt.

4. The fluid-damped direct-drive bicycle riding platform according to claim 1, wherein a belt inner cover is fixed to the main beam, a belt outer cover is fixed to an outer side of the belt inner cover, and both the first pulley and a belt tensioning pulley are located inside the belt inner cover and the belt outer cover.

5. The fluid-damped direct-drive bicycle riding platform according to claim 1, wherein a tower base is further connected to the second pulley, a flywheel sleeves the tower base.

6. The fluid-damped direct-drive bicycle riding platform according to claim 1, wherein a left sleeve shaft and a spacer bush are connected to a left end of the main shaft, and a right sleeve shaft is connected to a right end of the main shaft by threads.

7. The fluid-damped direct-drive bicycle riding platform according to claim 1, wherein a left tube end and a right tube end of the front bottom foot tube are sleeved into first foot pads, and a left tube end and a right tube end of the rear bottom foot tube are sleeved into second foot pads.

8. The fluid-damped direct-drive bicycle riding platform according to claim 1, wherein the power module fixing base is provided with a power module fixing slot, and the power module is inserted into the power module fixing slot to be fixed.

9. The fluid-damped direct-drive bicycle riding platform according to claim 1, wherein the side of the second pulley opposite to the main beam is provided with a sensing element fixing groove for placing the sensing element, the sensing element is fixed in the sensing element fixing groove, and the sensing element is located in a belt inner cover and a belt outer cover.

10. A method for using the fluid-damped direct-drive bicycle riding platform according to claim 1, comprising:

1) firstly, adjusting a height relative to a ground of an included angle between the front support rod and the main beam by the angle adjuster:

2) then removing a rear wheel of a bicycle, erecting a rear fork of the bicycle on a left sleeve shaft and a right sleeve shaft on the fluid-damped direct-drive bicycle riding platform, and locking the rear fork of the bicycle by a quick tightening shaft of the bicycle;

3) hanging a chain of the bicycle on a flywheel on the fluid-damped direct-drive bicycle riding platform and riding the bicycle, driving the flywheel on the fluid-damped direct-drive bicycle riding platform to rotate by the chain of the bicycle;

4) driving the second pulley to rotate through a tower base, driving the first pulley to rotate by the second pulley through a transmission of the belt, and driving the transmission shaft to rotate by the first pulley; and 5) driving the fluid resistor to work by the transmission shaft, and generating a resistance by using damping characteristics of a viscous fluid to consume a work done by a rider, so as to achieve training and fitness purposes.

* * * * *